United States Patent [19]

Scott

[11] 3,942,490

[45] Mar. 9, 1976

[54] VALVE TRAIN APPARATUS

[75] Inventor: Donald H. Scott, Dearborn, Mich.

[73] Assignee: Ford Motor Company, Dearborn, Mich.

[22] Filed: Dec. 23, 1974

[21] Appl. No.: 535,931

[52] U.S. Cl. ..... 123/90.4; 123/32 F; 123/32 JT; 123/90.41; 123/90.2

[51] Int. Cl.[2] ..... F01L 1/18

[58] Field of Search ..... 123/90.4, 90.41, 90.2, 123/90.1, 32 JT, 32 AL, 32 F, 32 G

[56] References Cited

UNITED STATES PATENTS

| | | | |
|---|---|---|---|
| 2,700,966 | 2/1955 | Hofer | 123/90.4 |
| 3,884,199 | 5/1975 | Irimajiri | 123/90.4 |

*Primary Examiner*—Charles J. Myhre
*Assistant Examiner*—Daniel J. O'Connor
*Attorney, Agent, or Firm*—Roger E. Erickson; Keith L. Zerschling

[57] ABSTRACT

Valve train apparatus for an internal combustion engine having two poppet-type intake valves per cylinder. The valve train include a generally conventional rocker arm actuated either by a pushrod or an overhead camshaft. One end of the rocker arm actuates a first intake valve. A second rocker arm is pivotally mounted at one end to the cylinder head and contacts the first intake valve at its opposite end. An intermediate location on the second rocker arm contacts a second intake valve. The first intake valve engages a flanged element at the end of the valve stem opposite the valve head. The first rocker arm contacts the top surface of the flanged element while the second rocker arm contacts a bottom surface of the flanged element. This construction permits flexibility in the positioning of the second valve. The second intake valve and its valve train apparatus can be rotated in a plane about the axis of the first intake valve to obtain optimum positioning of the second intake valve.

7 Claims, 4 Drawing Figures

VALVE TRAIN APPARATUS

BACKGROUND AND SUMMARY OF THE INVENTION

This invention relates to valve train apparatus for an internal combustion engine of the type having a pre-chamber or torch-type combustion ignition. Such an engine requires three valves per cylinder: a main combustion chamber intake valve, a secondary intake valve to the pre-chamber and a conventional exhaust valve.

The invention provides valve train apparatus which permits a main intake valve rocker arm to operate in a plane positioned at an angle to the operating plane of the pre-chamber valve rocker arm. The invention further provides valve train apparatus in which lash of the pre-chamber valve is adjustable independently of the lash of the main chamber valve. The invention also provides valve train apparatus for the operation of a secondary intake valve which is economical to produce, reliable in operation and which permits flexibility in the cylinder head design.

Valve train apparatus constructed in accordance with this invention includes first and second poppet-type intake valves mounted in a cylinder head so the ends protrude therefrom. A first rocker arm is pivotally mounted on a fulcrum and has one end contacting the protruding end of the first valve. One end of the second rocker arm is pivotally mounted to a second fulcrum while its other end engages the protruding end of the first intake valve. An intermediate portion of the second rocker arm contacts the protruding end of the second intake valve.

DETAILED DESCRIPTION OF THE PREFERRED EMBODIMENT

Figure 1:
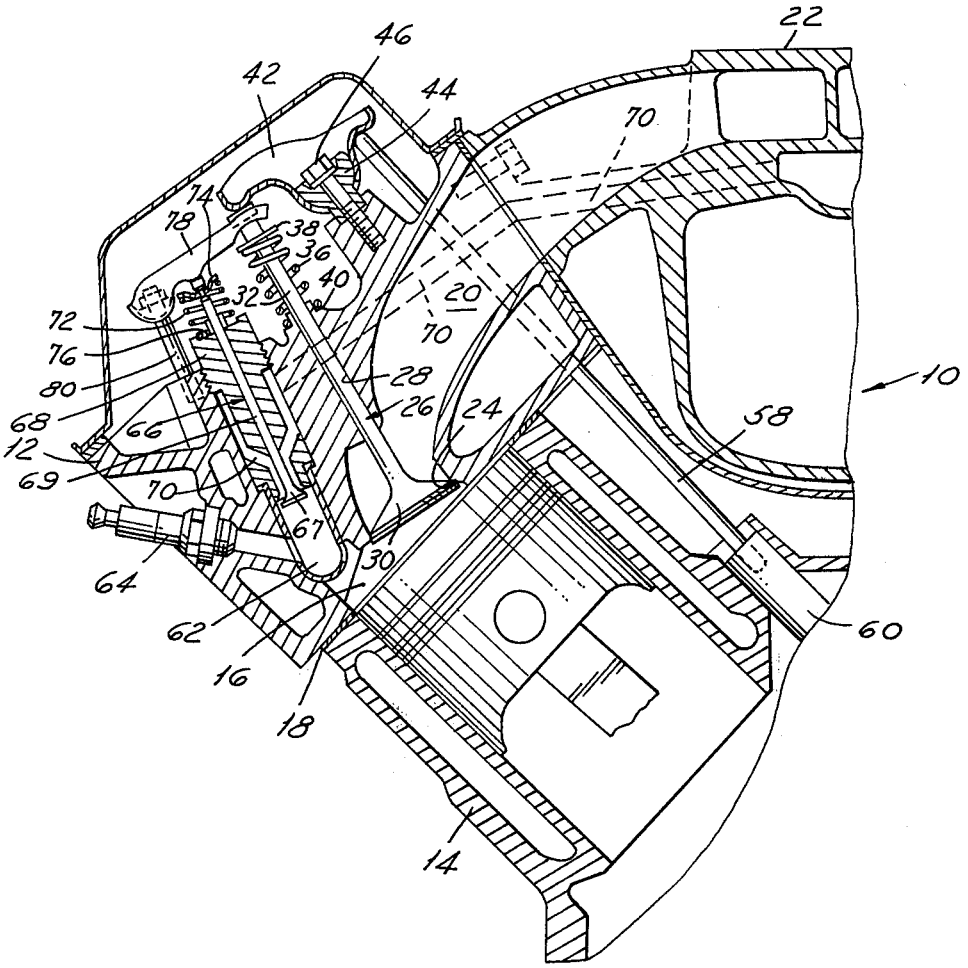
FIG. 1 is a transverse cross sectional view of a V-8 type internal combustion engine having a pre-chamber, torch-type ignition system and two intake valves and one exhaust valve per cylinder.
Figure 2:
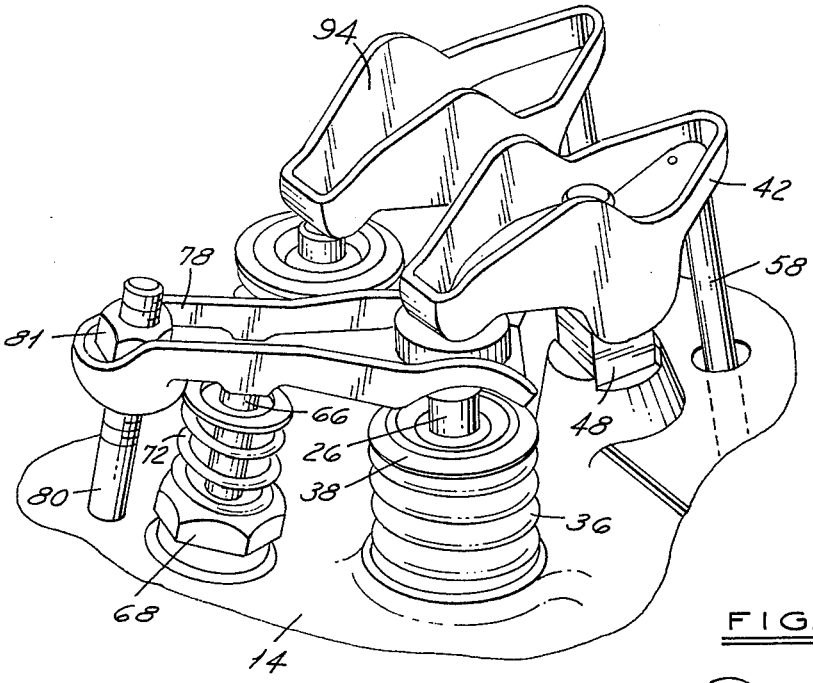
FIG. 2 is an elevational view of the valve train constructed in accordance with this invention.
Figure 3:
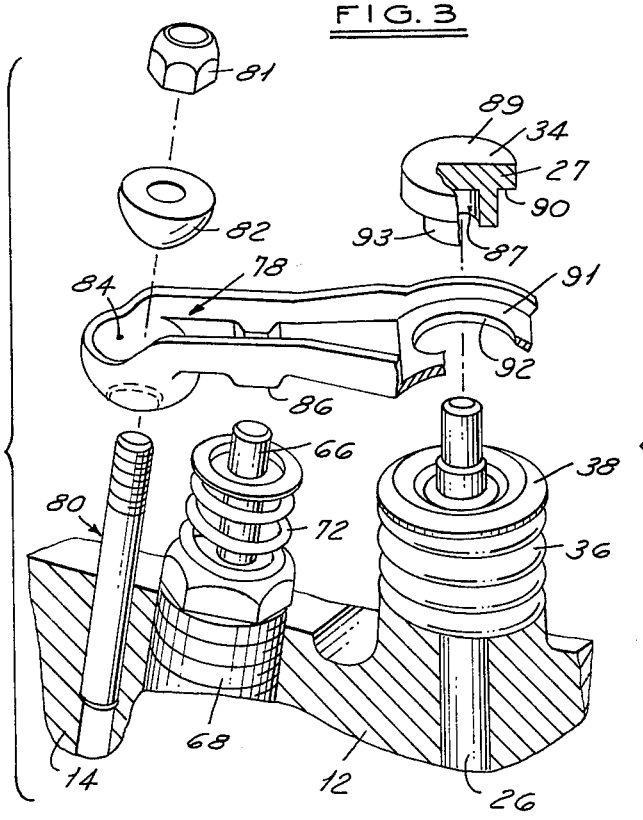
FIG. 3 is an exploded elevational view of the second rocker arm valve train apparatus.
Figure 4:
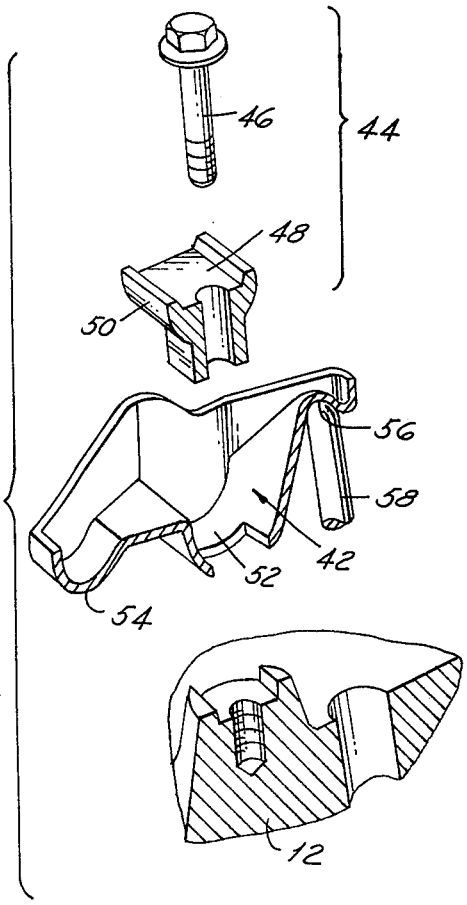
FIG. 4 is an exploded elevational view of the first rocker arm valve train apparatus.

In FIG. 1 of the drawings reference numeral 10 refers to a portion of an internal combustion engine. A cylinder head 12 is attached to the engine block 14. A primary combustion chamber 16 is formed in the cylinder head adjacent the mating surface 18 adjoining the engine block 14. A main fuel induction passage 20 connects the combustion chamber 16 and the intake manifold 22. A valve seat 24 is formed at the delivery or port end of the induction passage 20. A poppet-type intake valve assembly 26 is reciprocably mounted in a valve guide bore 28 formed in the cylinder head. The valve assembly includes a head portion 30 sealingly engageable with the seat 24, stem portion 32 extending generally upwardly from the head portion and a flanged cap element 34 positioned over and about the protruding end portion of the stem 32. The valve is biased upwardly and toward a closed position by a compression spring 36 acting between a spring retainer 38 secured to the valve stem and valve guide boss 40 formed in the cylinder head. A rocker arm 42 is pivotally mounted to the cylinder head by a fulcrum means 44 which comprises a cap screw 46 and a bearing element 48 having a convex cylindrical surface 50 corresponding to a concave cylindrical surface 52 formed in the rocker arm 42. In the illustrated V-type internal combustion engine, the rocker arm fulcrum 44 is positioned intermediate the valve engaging portion 54 and the push rod engaging portion 56 of the rocker arm. A push rod 58 extends from the rocker arm 42 to tappet 60 which, in turn, is operated by a cam shaft (not shown). The tappet is hydraulic of a type generally used in current engines.

A precombustion chamber 62 is positioned within the cylinder head 12 between the main combustion chamber 16 and a spark plug 64. A second, smaller poppet-type intake valve 66 is reciprocally mounted in a valve guide member 68 of the cylinder head and regulates flow of a fuel-air mixture through passage 70 into the precombustion chamber. Valve 66 includes a head 67 adjacent the chamber 62 and a stem 69 which protrudes from the cylinder head. The valve is resiliently biased to a closed position by a compression spring 72 acting between retainer 74 and valve guide boss 76. A second rocker arm 78 is positioned between the first intake valve 26 and a second fulcrum member 80. The plane of action of rocker arm 78 is at an angle with the plane of action of rocker arm 42. Fulcrum member 80 includes a lock nut 81 for adjusting lash and a spherically convex bearing element 82 which corresponds to a spherically concave portion 84 of the rocker arm 78 and an intermediate pad 86 of the rocker arm engages the end of the precombustion chamber valve stem 66. It can, thus, be seen when the tappet 60 moves upwardly as shown in FIG. 1 of the drawings, the first rocker arm 42 pivots and depresses first intake valve 26 which, in turn, causes second rocker arm 78 to pivot and depress the second intake valve 66.

Intake valve assembly 26 is engageable with both the first rocker arm 42 and the second rocker arm 78. The intake valve 26 includes a cap 34 having a bore 87 which receives the tip of the valve stem 32 and provides an upwardly forcing circular surface 89 and a downwardly facing annular surface 90. The upper surface 89 engages the valve engaging portion 54 of the first rocker arm 42, while the lower surface 90 engages a cylindrical pad 91 of the second rocker arm 78. Pad 91 includes an opening 92 through which a portion 93 of cap 34 extends. It can be seen that to open port 24, rocker arm 42 pushes downwardly on cap 34 of valve assembly 26 which, in turn, pushes downwardly on the stem of valve 26 as well as on the rocker arm 78. Rocker arm 78 pivots about fulcrum 80 and depresses secondary valve 66.

It may be seen from the foregoing that the secondary or precombustion valve 66 and a precombustion chamber 62 may be located in a plane separate from the plane of action of the first rocker arm 42. This has advantages in engine design in that the precombustion chamber may be positioned between the planes of operate of the intake valve and exhaust valve rocker arms 42 and 94.

Valve lash between the second rocker arm 78 and the precombustion chamber 66 valve may be adjusted by rotation of lock nut 81.

Modifications and alterations will occur to those skilled in the art which are included in the scope and spirit of the following claims.

I claim:

1. Valve train apparatus for an internal combustion engine having a cylinder head, said apparatus including first and second poppet-type intake valves slidably mounted in said cylinder head and having end portions protruding therefrom, a first rocker arm, first fulcrum means to pivotally mount said rocker arm to said cylinder head, a second rocker arm, second fulcrum means mounted to said cylinder head, one end of said second rocker arm being pivotally mounted to said second fulcrum means, the other end of said second rocker arm engaging the protruding end portion of said first intake valve, an intermediate portion of said second rocker arm being engageable with the protruding end portion of said second intake valve, said first rocker arm having one end engaging the protruding end of said first valve, said first intake valve having a stem and a head on one end of said stem, said stem including a flanged element on the other end of the stem portion, a bore formed in said cylinder head slidably receiving said stem portion so that the end of said stem portion having said flanged element protrudes from said cylinder head, said flanged element having a first surface generally perpendicular to the axis of said valve stem and facing away from said valve head and a second surface generally perpendicular to the axis of said valve stem and facing toward said valve head, said first rocker arm engaging the first surface of said flanged element, said second rocker arm engaging the second surface of said flanged element.

2. Valve train apparatus according to claim 1, said flanged element comprising a cap positioned about the protruding end of said valve stem and being separable therefrom.

3. Valve train apparatus for an internal combustion engine having a cylinder head, said apparatus including first and second poppet-type intake valves slidably mounted in said cylinder head and having end portions protruding therefrom, a first rocker arm, first fulcrum means to pivotally mount said rocker arm to said cylinder head, a second rocker arm, second fulcrum means mounted to said cylinder head, one end of said second rocker arm being pivotally mounted to said second fulcrum means, the other end of said second rocker arm engaging the protruding end portion of said first intake valve, an intermediate portion of said second rocker arm being engageable with the protruding end portion of said second intake valve, said first rocker arm having one end engaging the protruding end of said first valve, said first intake valve including a stem and a head on one end of said stem, said stem having a shaft portion and an end portion, a valve guide bore formed in said cylinder head reciprocably receiving said shaft portion, said end portion protruding from said cylinder head, said end portion having a first surface generally perpendicular to said valve shaft directed away from said head, said end portion having a second surface generally perpendicular to said valve stem directed toward said head, said first rocker arm engaging said first surface, said second rocker arm engaging said second surface.

4. Valve train apparatus according to claim 3, said end portion of said valve stem comprising a cap, said cap having a bore receiving the end of said valve stem shaft opposite said head, said cap including a flange, said first surface comprising one surface on said flange and said second surface comprising an opposite surface on said flange.

5. Valve train apparatus according to claim 4, said other end of the second rocker arm having an opening formed therein receiving a portion of said cap, said second surface on said flange overlying said portions of said second rocker arm immediately adjacent said opening.

6. Valve train apparatus according to claim 4, said other end of the second rocker arm having a convex cylindrical surface, said opening formed in said cylindrical surface, said flange being annular and overlying portions of said cylindrical surface adjacent said opening.

7. Valve train apparatus according to claim 4, said one end of the second rocker arm having a concave spherical socket, said second fulcrum means having a convex spherical member corresponding to and engaging said concave spherical socket.

* * * * *